United States Patent [19]

Marforio

[11] 4,075,957

[45] Feb. 28, 1978

[54] WORKPIECE GUIDE FOR SEWING MACHINES

[75] Inventor: Nerino Marforio, Milan, Italy

[73] Assignee: Rockwell-Rimoldi S.p.A., Milan, Italy

[21] Appl. No.: 705,601

[22] Filed: Jul. 15, 1976

[30] Foreign Application Priority Data

Jul. 21, 1975 Italy ..... 25585/75

[51] Int. Cl.[2] ..... D05B 35/10

[52] U.S. Cl. ..... 112/153

[58] Field of Search ..... 112/153, 152, 143, 121.11

[56] References Cited

U.S. PATENT DOCUMENTS

| | | | |
|---|---|---|---|
| 3,794,230 | 2/1974 | Bryan et al. | 112/153 X |
| 3,875,881 | 4/1975 | Marforio | 112/153 |
| 3,913,507 | 10/1975 | Pollmeier | 112/153 |

FOREIGN PATENT DOCUMENTS

| | | | |
|---|---|---|---|
| 644,844 | 9/1962 | Italy | 112/153 |

*Primary Examiner*—Werner H. Schroeder

[57] ABSTRACT

A workpiece guide for a sewing machine which comprises a guide made up of a pivotably mounted body having a plurality of integrally formed and outwardly extending plates that define vertical walls on the end adjacent the main body and means to rotate the entire guide about an axis located to the right of the sewing axis.

5 Claims, 4 Drawing Figures

WORKPIECE GUIDE FOR SEWING MACHINES

BACKGROUND OF THE INVENTION

The present invention relates to a workpiece guide for sewing machines.

This guide is of the type comprising: one or more superposed plates which are spaced apart and disposed substantially parallel to the work surface of the sewing machine and at right angles to the sewing axis, a vertical wall disposed between one plate and the work support surface and one or more vertical walls disposed between the plates.

In the case of the known guide, the plates may be stationary with respect to the sewing axis or they may be totally or partially displaceable with respect thereto by means of a translational or rotational movement, thereby facilitating insertion of the workpiece beneath the presser foot of the sewing machine and permitting the passage of thicker portions of the layers forming the workpiece resulting, for example, from the presence of pockets, belts, etc.

The object of the present invention is to obviate a common disadvantage of the guides comprising movable plates which are most widely used for matching two pieces of fabric which are to be joined together.

For displacement of the plates, the conventional guides are provided with openings within which the plates can be displaced. These openings form clearance slits or gaps between the movable plates and the stationary walls of the guide. It has been found that during the sewing operation some of the threads which protrude from the edges of the layers of fabric to be joined will enter into these slits or gaps so as to prevent said layers of fabric from sliding freely between the plates in the direction of the sewing elements. Such a condition will create undesirable bunching or crumpling of the fabric whereby one layer will be out of alignment with the other during the stitching operation.

To obviate the above-mentioned disadvantage, the technical problem which the present invention is intended to solve consists in providing a guide devoid of the so-called slits or gaps between the plates and the vertical walls in the zone in which edges of the layers are pressed against the vertical walls while still enabling the plates to be moved away from the sewing elements.

The object of the present invention is to ensure that the guide is automatically displaced when the sewing machine starts or stops.

The above-mentioned technical problem is solved and the above object attained by means of the guide according to the present invention which comprises a base plate integral with the guide disposed beneath the vertical wall and interposed between lower plates and the work surface; a stationary bedplate comprising a recess adapted to receive the base plate while enabling it to be displaced therein; means for displacing the entire guide with respect to the base plate on the right of the sewing axis so as to move it away from the sewing elements.

Other objects, features and advantages of the present invention will be made apparent in the course of the following detailed description of the guide according to the invention which is provided by way of non-limitative example only with reference to the accompanying drawings in which:

DESCRIPTION OF THE INVENTION

Figure 1:
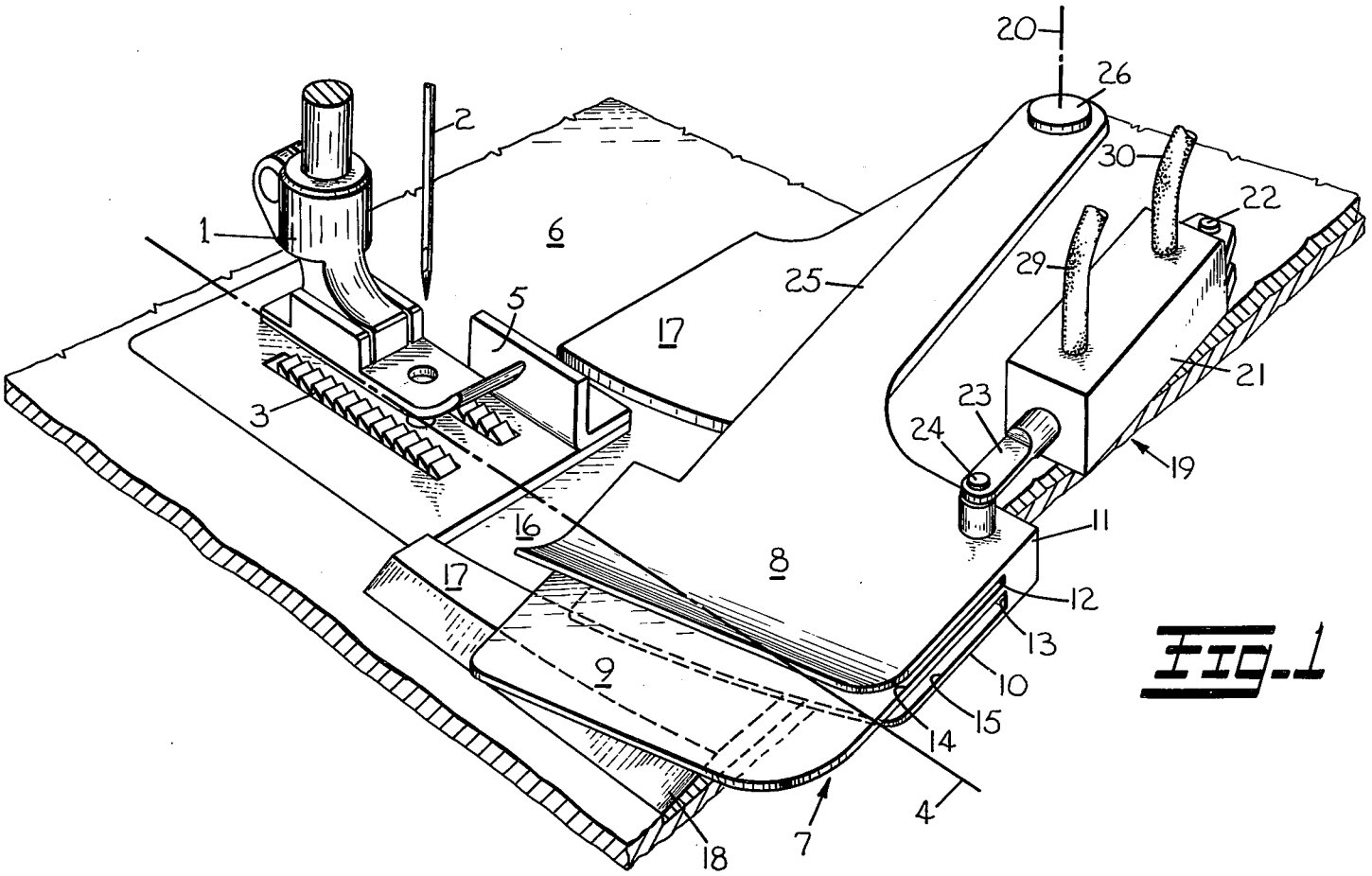
FIG. 1 is a perspective view of the guide in an inoperative position and spaced apart from the sewing elements of the sewing machine.
Figure 2:
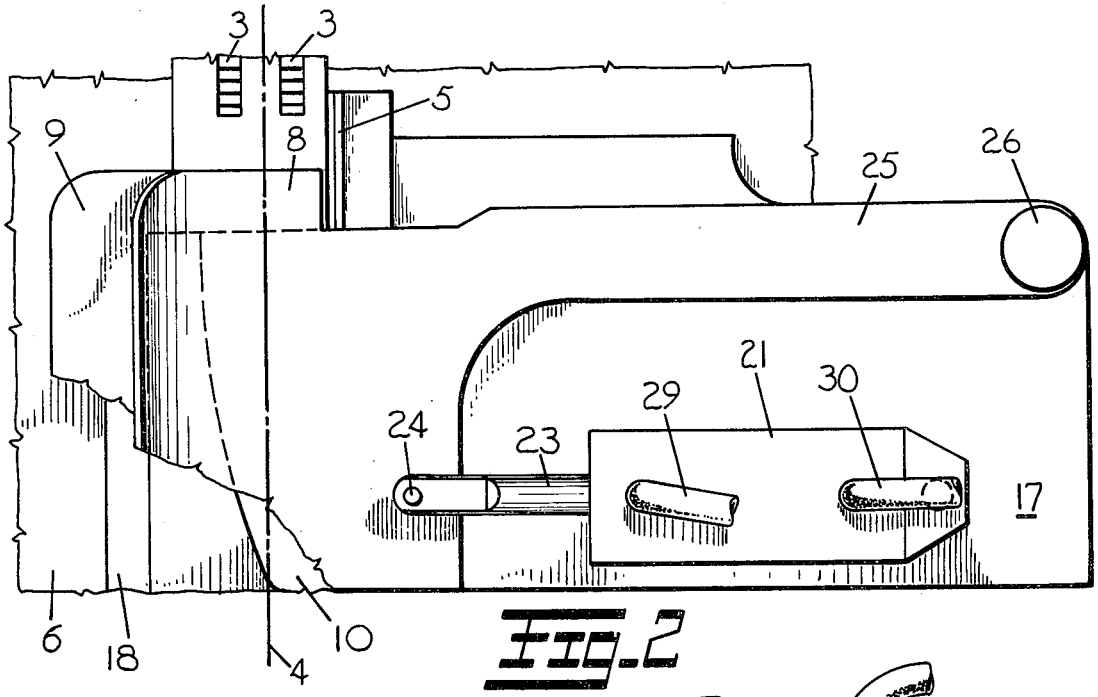
FIG. 2 is a plan view of the guide rotated into the work position.
Figure 3:
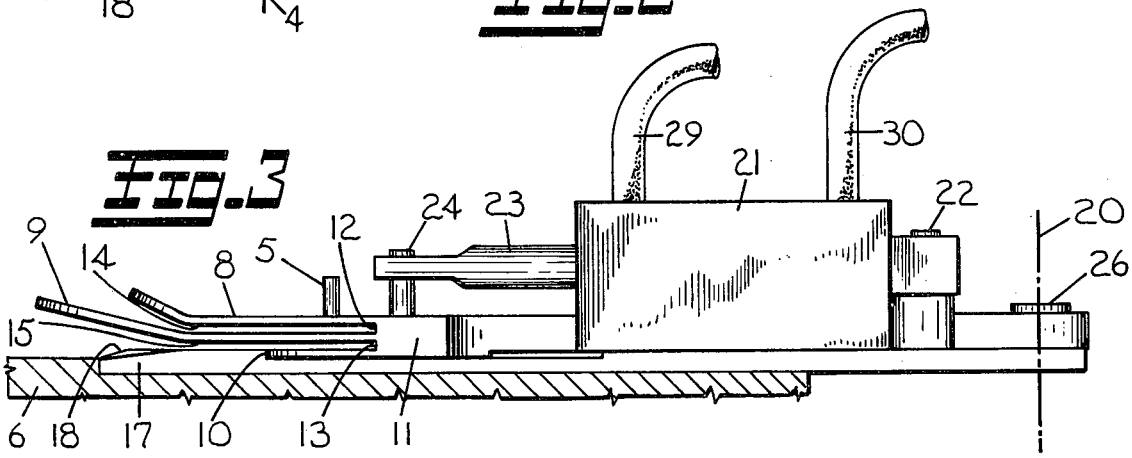
FIG. 3 is a front view of the guide rotated into the work position.

Referring now to FIG. 1 which shows a presser foot 1, a needle 2 and the advancement means 3 for a normal sewing machine (not shown).

A stationary guide 5 consisting of a vertical wall integral with the work surface 6 of the sewing machine and a movable guide 7 are disposed on the right of a sewing axis 4. The movable guide 7 is formed by an upper plate 8, a lower plate 9, and a base plate 10 which are arranged one above the other in the given order, spaced apart from one another and disposed parallel to the work surface.

The above-mentioned plates are integral with an end wall 11 such that vertical walls 12, 13 are defined between the plates.

The upper plate 8, the lower plate 9 and the vertical wall 12 together define a guide channel 14 for an upper layer of fabric and the lower plate 9, the base plate 10 and the vertical wall 13 define a guide channel 15 for a lower layer of fabric. The base plate 10 is received in a recess 16 in a bedplate 17 integral with the work surface 6 of the sewing machine. The recess 16 is defined by at least one curved wall that is shaped to mate with the outermost wall of base plate 10, as viewed in FIG. 1.

The bedplate 17 also comprises a bevel 18 designed to keep the lower layer of fabric slightly raised from the work surface so that it can be more easily slid and inserted into the guide channel 15.

The movable guide 7 comprises means 19 for rotating the entire guide with respect to the bedplate 17 about a vertical axis 20 passing through a point situated on the right of the sewing axis 4. The means 19 comprise a double-acting pneumatic cylinder 21, the body of which is hinged at 22 to the bedplate 17 and the stem 23 of which is hinged at 24 to the upper plate 8 in correspondence with the end wall 11 of the movable guide. The upper plate 8 comprises an arm 25, the free end of which is hinged at 26 on the bedplate 17.

Figure 4:
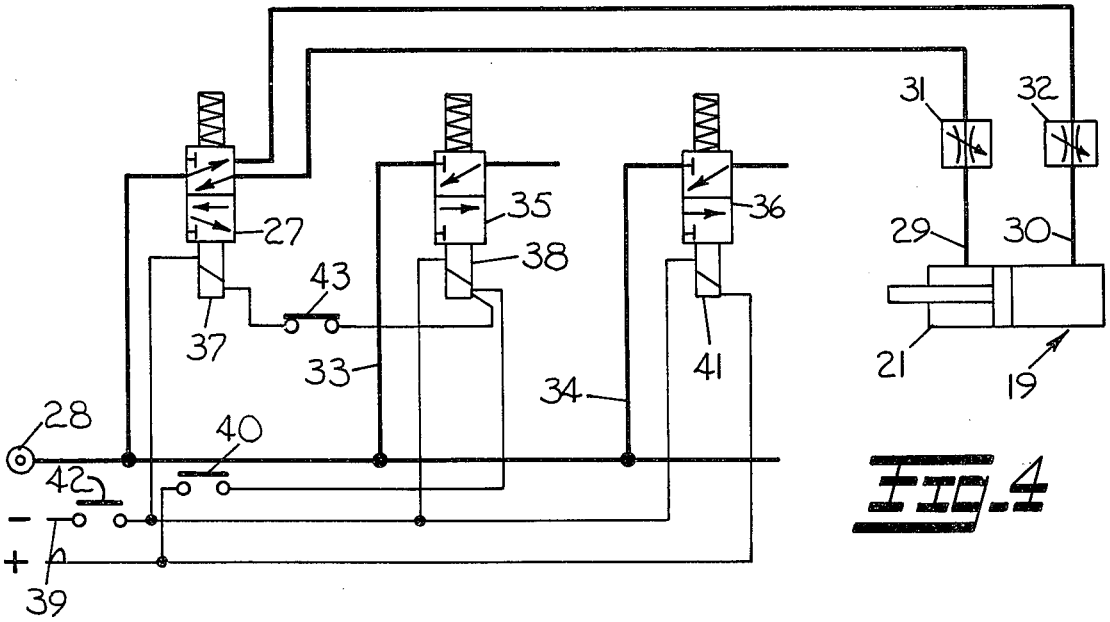
FIG. 4 shows the pneumatic control circuit controlling the rotation of the guide.

Referring now to FIG. 4, the means for rotating the guide also includes a five-way direction control electrovalve 27 which is supplied by means of a compressed air line 28 and which, in turn, supplies one or other of the chambers of the cylinder 21 by means of two conduits 29 and 30, each of which is equipped with a volume regulator 31 and 32, respectively. The latter constitute means for regulating the rotational speed of the guide. Two other lines 33 and 34 branch off from the line 28. The two lines 33 and 34 are designed to supply power for starting and stopping the electric motor for driving the sewing machine and for raising the presser foot 1. More specifically, a three-way direction control electrovalve 35 which is adapted to supply a pneumatic control means (not shown) for controlling the clutch of the electric motor, is inserted in line 33 and an electrovalve 36 designed to supply a pneumatic cylinder (not shown) which is connected to the presser bar of the sewing machine for lowering or raising the presser foot 1, is inserted in line 34.

The exciting windings 37 and 38 of the electrovalves 27 and 35 are connected in parallel to an electric line 39 and are simultaneously excited by means of a control contact 40 disposed in series with both electrovalves. The contact 40 may be activated by a relay (not shown) which can be controlled manually or by means of a photocell. The two electrovalves 27 and 35 which are connected in such a way that they may be simultaneously closed or open, constitute means for synchronizing the rotation of the guide with the starting or stopping of the sewing machine. The exciting winding 41 of the electrovalve 36 is also connected in parallel to line 39 and is excited by means of a control contact 42 activatable by means of a relay (not shown) which may be controlled manually or by means of a manual control (knee operative).

The guide operates in the following manner: when the sewing machine is not in operation the presser foot is in the raised position and the guide is in the rotated position shown in FIG. 1 such that the operator can easily insert the workpiece beneath the presser foot of the sewing machine and can insert one of the layers forming the workpiece in guide channel 14 and the other layer in guide channel 15. In this position the electrovalve 27 sends compressed air into conduit 29 and thus keeps the piston stem 23 of the cylinder 21 in a fully retracted position. When the control contact 42 is actuated, the electrovalve 36 is excited and air is admitted to a pneumatic cylinder which controls the lowering of the presser foot 1. At this point the operator can actuate the control contact 40 in order to simultaneously excite the two electrovalves 27 and 35 and thus start the sewing machine and reverse the intake of compressed air from conduit 29 to conduit 30. This reversal causes the stem 23 to be extended from cylinder 21 and results in the guide being rotated about the axis 20 which is brought into the work position.

By virtue of the fact that the sewing machine is already in operation and has already begun to advance and sew the workpiece when the guide is rotated, it is necessary for the rate of rotation of the guide to be equal to or slightly less than the advancement rate so as to prevent crumpling of the workpiece. The volume regulators 31 and 32 are responsible for regulating the rate of rotation of the guide. Should it be necessary to displace the guide in the course of sewing to permit the passage of thicker portions of fabric, the operator must keep open a contact 43 which is normally closed and which is connected in series in the supply line to the winding 37, so as to produce excitation thereof and thus reverse the passage of compressed air from conduit 30 to conduit 29. When the sewing operation has been completed, the following operations are triggered by a control means comprising a photocell which determines when the sewn workpiece emerges from the presser foot: the control contacts 40 and 42 are opened and consequently there results the raising of the presser foot, the motor of the sewing machine is arrested and the guide is rotated into a position which is spaced apart from the sewing elements, thereby facilitating insertion of a fresh workpiece.

The position into which the guide is rotated may be such that the plates intersect the sewing axis, as shown in the embodiment according to FIG. 1, or it may be such that the plates are completely removed from the sewing axis. The first solution is employed when it is wished to ensure that the layers of the workpiece always remain in their respective guide channels — even when the guide is being rotated. This is a particular advantage when sewing especially light fabrics, for example, linings.

As the guide channels do not possess any slits or gaps, it is not possible for any possible frayed portions on the edges of the fabric to become stuck in the proximity of the vertical walls 12 and 13, thus obstructing the sewing operation.

The only slit which is present is the one between the baseplate 10 and the bedplate 17 in correspondence with the recess 16. However, this slit is sufficiently far away from the zone where the frayed edges of fabric will be located during the sewing operation.

What is claimed is:

1. A workpiece guide for a sewing machine having a work surface comprising:

(a) superposed upper, lower and base plates formed integrally with said guide which are spaced apart and disposed substantially parallel to the work surface and at right angles to the sewing axis;

(b) at least one integrally formed vertical wall disposed between said upper, lower and base plates and between the lower plate and the work surface, said vertical walls being disposed to the right of the sewing axis and being substantially convergent with said axis;

(c) a stationary bed plate including means defining a recess with arcuately shaped limits for receiving said base plate; and (d) means for rotating the entire guide with respect to said bed plate about a vertical axis passing through a point situated on the right of the sewing axis and to a location displaced from the sewing elements.

2. A workpiece guide as claimed in claim 1 wherein the means for rotating the guide comprises a double-acting pneumatic cylinder, the body of which is hinged to said bedplate and the piston stem of which is hinged to one of said plates comprising the guide.

3. A workpiece guide as claimed in claim 1 wherein said means for rotating the guide with respect to the bedplate comprises means for synchronizing the rotation of said guide with the starting or stopping the sewing machine.

4. A workpiece guide as claimed in claim 1, wherein said means for rotating said guide comprise means for regulating the rate of rotation of the guide.

5. A workpiece guide as claimed in claim 3 wherein said means for synchronizing the rotation of said guide with the starting or stopping of the sewing machine comprises a five-way direction control electrovalve adapted to supply the double-acting pneumatic cylinder a three-way direction control electrovalve adapted to supply a clutch control means of the electric motor of the sewing machine and means to excite the windings 38 and 37 of these electrovalves simultaneously.

* * * * *